United States Patent [19]

Zang

[11] Patent Number: 4,803,672

[45] Date of Patent: Feb. 7, 1989

[54] ELECTRIC TIMEPIECE

[75] Inventor: Klaus D. Zang, Homburg, Fed. Rep. of Germany

[73] Assignee: Walter GmbH, Mettlach, Fed. Rep. of Germany

[21] Appl. No.: 82,787

[22] Filed: Aug. 6, 1987

[30] Foreign Application Priority Data

Aug. 11, 1986 [DE] Fed. Rep. of Germany ..... 8621553

[51] Int. Cl.[4] ..... G04C 17/00

[52] U.S. Cl. ..... 368/241; 368/316; 368/228

[58] Field of Search ..... 368/240, 82, 83, 239, 368/241

[56] References Cited

U.S. PATENT DOCUMENTS

| | | | |
|---|---|---|---|
| 2,169,208 | 8/1939 | Adams | 368/240 |
| 3,596,462 | 8/1981 | Hayes | 368/82 |
| 3,958,409 | 5/1976 | Manber | 368/240 |
| 4,007,583 | 2/1977 | Johnson | 368/240 |
| 4,041,692 | 8/1977 | Marshino | 368/240 |

FOREIGN PATENT DOCUMENTS

| | | | |
|---|---|---|---|
| 2341889 | 9/1977 | France | 368/240 |
| 12666 | 2/1978 | Japan | 368/82 |

*Primary Examiner*—Bernard Roskoski
*Attorney, Agent, or Firm*—Peter K. Kontler

[57] ABSTRACT

An electric timepiece having a square dial with corners at the twelve, three, six and nine o'clock positions has a first array of twelve light sources at one to twelve o'clock positions, a second array of four light sources which are inwardly adjacent the light sources of the first array at the twelve, three, six and nine o'clock positions, and a centrally located light source. The color and/or intensity of radiation issuing from the centrally located light source changes at midnight and at noon, and all of the remaining light sources are used to indicate minutes. The light sources of the second array indicate single-minute periods, and the light sources of the first array indicate five-minute periods. In addition, the light sources of the first array are used to indicate hours in colors or hues other than those used to denote five-minute periods.

14 Claims, 2 Drawing Sheets

ELECTRIC TIMEPIECE

CROSS-REFERENCE TO RELATED CASE

An electric timepiece having a dial which is similar to the dial of the timepiece of the present invention is shown in commonly owned copending design patent application Ser. No. 012,706 filed Feb. 10, 1987.

BACKGROUND OF THE INVENTION

The invention relates to improvements in electric timepieces.

Heretofore known electric timepieces employ hands, dials (analog indication) or changing numerals (dialog indication). Certain presently known electric timepieces are described and shown in German Utility Models Nos. G 84 34 084 and G 85 12 790. They can be classified as analog timepieces in that they operate with illuminated indicia. Such conventional electric timepieces employ a total of twelve plus sixty radiation sources to indicate hours and minutes. The indicia are arranged in a circle. There is no provision to distinguish between morning and afternoon hours, i.e., between 0–12 hours and 2–24 hours.

OBJECTS AND SUMMARY OF THE INVENTION

An object of the invention is to provide an electric timepiece (such as a watch or a clock) which employs radiation sources and wherein the number of such radiation sources is reduced to a minute fraction of those in a conventional timepiece but without reducing the accuracy and/or simplicity of ascertaining the exact time of the day.

Another object of the invention is to provide an electric timepiece which can accurately indicate all times of the day including the difference between morning and afternoon hours.

A further object of the invention is to provide a novel and improved dial for use in the above outlined timepiece.

An additional object of the invention is to provide novel and improved arrays of indicia on the above outlined dial.

Still another object of the invention is to provide a novel and improved circuit for use in the above outlined timepiece.

An additional object of the invention is to provide a novel combination of a dial and indicia for use in the above outlined timepiece.

A further object of the invention is to provide a novel and improved method of indicating times of the day with an electric timepiece.

The improved electric timepiece comprises a dial having twelve first radiation sources forming a substantially annular first array, and a second array of four second radiation sources within the confines of the first array. Each radiation source is arranged to emit radiation in response to connection with a source of electrical energy, and the timepiece further comprises means for selectively connecting the radiation sources to a suitable energy source, e.g., to a wall outlet.

The radiation sources of the first array can form a square or a rectangle with a radiation source at each corner of the first array and with two radiation sources between each pair of neighboring corners.

The dial can have a polygonal outline and can include a plurality of corner portions with one of these corner portions located at a level below all other corner portions when the improved timepiece is properly set up on a night table, on a table, on a desk, on a mantel or on any other suitable support. If the dial has a substantially square outline, i.e., if it has four equal or nearly equal sides, the first radiation sources preferably form four rows of four radiation sources each. Each row is adjacent and substantially parallel to one of the four sides of the dial, and each first radiation source at a corner of the first array is common to a pair of rows. The radiation sources of the second array are or can be distributed in such a way that they form two pairs and the radiation sources of the two pairs are mirror symmetrical to each other with reference to a plane which is normal to the dial and is located between the two pairs of second radiation sources.

At least one additional (seventeenth) radiation source is preferably located at the center of the first array; such center can coincide with the center of the second array.

At least one of the radiation sources on the dial is preferably designed to have means for emitting radiation (such as visible light) of a first color or hue, and at lest one other radiation source can be designed to have means for emitting radiation (particularly visible light) of a different second color or hue. Furthermore, the radiation sources can differ in size and/or shape. Such differently configurated and/or dimensioned radiation sources can be resorted to in order to enhance the appearance of the timepiece and/or to facilitate the determination of exact time. For example, certain radiation sources can have a circular outline, certain radiation sources can have a polygonal outline and certain radiation sources, or the additional radiation source, can have a different third (e.g., oval) outline. The dimensions of the radiation sources which form the first arrays can be smaller or greater than those of the radiation sources which form the second array.

At least one of the as many as seventeen or eighteen radiation sources can include or constitute a light emitting diode which is designed to emit light of different colors or hues. Such light emitting diodes are available on the market.

The radiation sources of the first array preferably occupy one to twelve o'clock positions on the dial. The four radiation sources of the second array can be installed in such a way that they are inwardly adjacent the first radiation sources at the twelve, three, six and nine o'clock positions.

The radiation sources of the first and/or second array can be equidistant from each other.

The novel features which are considered as characteristic of the invention are set forth in particular in the appended claims. The improved timepiece itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
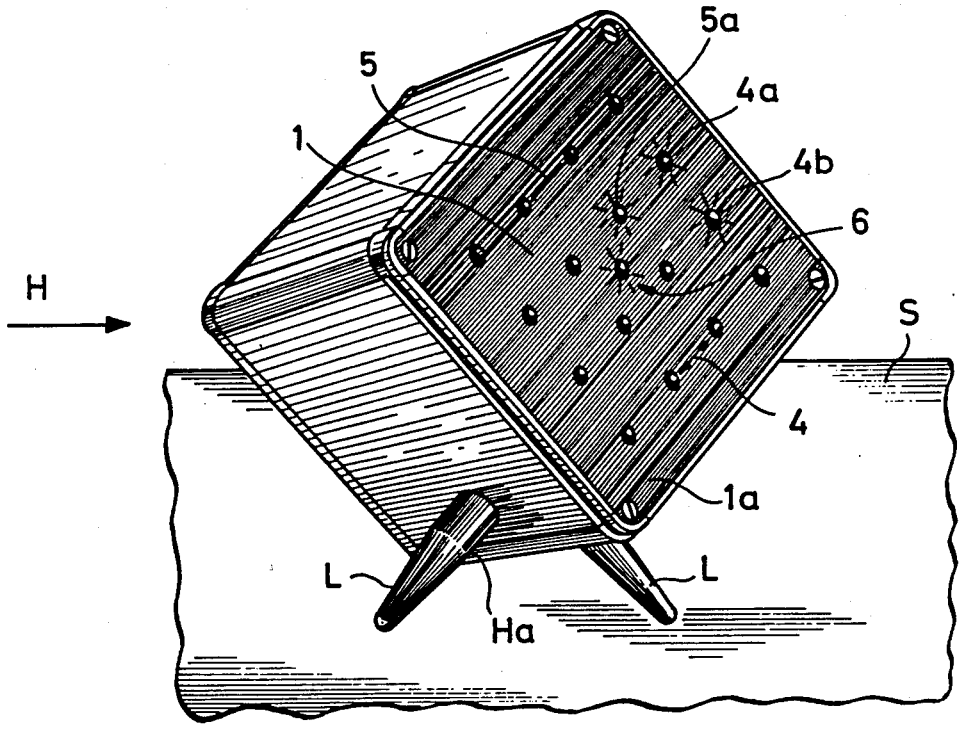
FIG. 1 is a schematic perspective view of an electric timepiece which embodies one form of the invention.

FIG. 1 shows an electric timepiece which can be used as a desk, table or mantel clock having a housing H with a polygonal (square) dial 1. The four corner portions of the dial 1 are respectively located at the twelve, three, six and nine o'clock positions and the lowermost corner portion la is kept above the supporting surface S by two legs L which extend from the lower sidewalls of the housing H and cooperate with the lower rear corner portion Ha of the housing H to provide a three-point support for the timepiece.

The dial 1 is provided with a total of seventeen radiation sources, namely a first (square) array of twelve equidistant radiation sources 4 which are located at the one to twelve o'clock positions, a second array of four equidistant radiation sources 5 which are located within the confines of the first array and are adjacent the radiation sources 4 occupying the twelve, three, six and nine o'clock positions, and a radiation source 6 which is located at the common center of the two arrays.

The radiation sources 4, 5 and 6 (each of which can constitute a light emitting diode) can be of the same size and/or shape, or the size and/or shape of the sources 4 can deviate from that of the source 6 and/or sources 5. Analogously, the size and/or shape of the sources 5 can deviate from that of the source 6.

The illuminated sources 4*a*, 4*b*, the illuminated source 5*a* and the illuminated source 6 jointly indicate that the time is 13:11 PM. Completion of the circuit of each source 4 in a first color and/or hue and/or with a first degree of intensity denotes a five-minute interval, and the illumination of a source 4 in a different color and/or hue and/or with a different degree of intensity denotes the respective hour. It is assumed that the intensity and/or color of radiation issuing from the source 4*a* is indicative of the hour and that the intensity and/or color of radiation issuing from the source 4*b* is indicative of a five-minute interval. However, since the source 4*b* lights up to indicate a five-minute interval only after the source 4*a* was already lighted or activated for the same purpose, the source 4*b* actually indicates ten minutes after the hour denoted by the source 4*a*. The source 5*a* is illuminated to denote a one-minute period, and the source 6 is illuminated or is illuminated in a particular color or hue or with a particular degree of intensity to indicate that the time is past noon but before midnight. It will be appreciated that the illustrated timepiece can indicate any other time of the day from midnight to midnight with the accuracy of up to one minute. For example, at high noon only the source 6 emits radiation or emits radiation of a particular color, hue or intensity. At midnight, all of the radiation sources are off for one minute. Not more than two sources 4 and only one of the sources 5 need emit radiation at any given time. Alternatively, not more than two sources 4 but one, two, three or all four sources 5 can emit radiation at the same time if the circuit which serves to connect selected radiation sources to the source of electrical energy is designed to illuminate one of the sources 5 to indicate a one-minute period, to illuminate two sources 5 in order to denote a two-minute period and so forth.

By way of example, the radiation sources 4 can be caused to emit green light in order to denote hours and to emit red light in order to denote five-minute periods. The radiation sources 5 can be caused to emit red light when they are to denote the respective "minute" intervals, and the radiation source 6 can emit red light to denote that the time is past noon but before midnight. A radiation source 4 can be caused to emit blue, white, yellow or any other light (other than green or red) if it is to simultaneously denote the hour as well as the corresponding five-minute period. The arrangement may be such that a period of say 40 minutes is denoted by simultaneous activation of sources 4 at the one to eight o'clock positions, or only by activation of the source 4 at the eight o'clock position.

It will be seen that the improved timepiece can indicate all times of the day with not more than seventeen or at most eighteen radiation sources.

While it is equally within the purview of the invention to distribute the radiation sources 5 in any one of many other ways, the illustrated array of such radiation sources is preferred at this time because it is believed to contribute to the appearance as well as to readability of the dial.

The problem which arises when one and the same radiation source 4 is to denote the respective hour as well as a five-minute period can be solved in the aforedescribed manner of using diodes which emit light in different colors so that the source 4 which would emit green light to denote the hour or red light to denote the respective five-minute period will emit light of a third color when it is to denote the hour of the day as well as the corresponding five-minute period. Such problem is analogous to that when the hour hand of a conventional watch or clock registers with and conceals the minute hand.

If desired, the single centrally located radiation source 6 can be replaced with two sources one of which emits radiation of a first color, hue and/or intensity from midnight to noon and the other of which emits radiation of a different second color, hue and/or intensity from noon to midnight.

Figure 2:
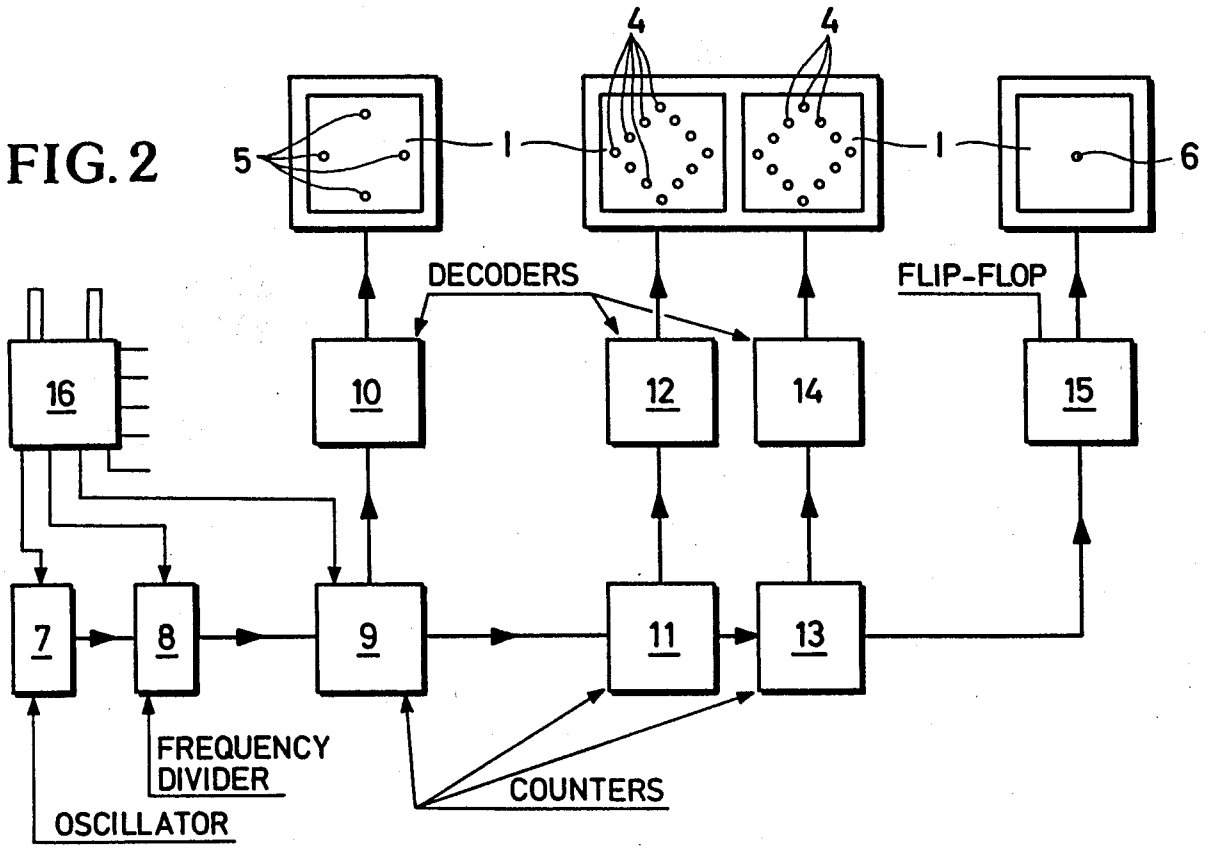
FIG. 2 is a block diagram of the means for selectively connecting the radiation sources to a source of electrical energy.

FIG. 2 shows, by way of example, a presently preferred circuit which can be installed in the housing H behind the dial 1 and serves to selectively illuminate the radiation sources 4, 5 and 6. This circuit comprises a quartz-stabilized oscillator 7 which can operate at a frequency of e.g., 32 kHz. The output of the oscillator 7 is connected with the input of a frequency divider 8 which reduces the oscillation frequency to 1 Hz and whose output is connected with the input of a first counter 9. The latter has a first output which is connected to the input of a first decoder 10 and a second output which is connected with the input of a second counter 11. The output of the decoder 10 is used to transmit signals at one-minute (sixty-second) intervals to successive radiation sources 5 so that the respective sources 5 emit radiation of the corresponding color, hue and/or intensity for one-minute periods. The second counter 11 receives signals from the corresponding output of the first counter 9 at five-minute intervals, and one output of the second counter 11 transmits signals to a second decoder 12 which serves to transmit signals (at five-minute intervals) to successive radiation sources 4 in a color, hue and/or at an intensity indicative of a five-minute period. The second output of the counter 11 is connected with the input of a third counter 13 one output of which is connected to the input of a third decoder 14. The counter 11 transmits signals to the counter 13 at one-hour intervals, and the decoder 14 then causes successive radiation sources 4 to emit radiation of a color, hue and/or intensity which is indicative of the respective hour of the day. A second output of the third counter 13 transmits signals (at 12-hour intervals) to a flip-flop circuit 15 which transmits an appropriate signal to the radiation source 6 so that this radiation source properly indicates the respective half of the day, namely the morning or the afternoon.

The counter 9 is reset to zero after each five-minute interval, the counter 11 is reset to zero after each 60-minute interval, and the counter 13 is reset to zero after each twelve-hour interval. The dial 1 is shown in FIG. 2 four times for the sake of clarity.

The reference character 16 denotes a plug or any other component which is used to connect the elements of the circuit to an energy source, e.g., to a wall outlet or to a battery.

The individual elements of the circuit of FIG. 2, as well as the radiation sources 4, 5 and 6, are or can constitute commercially available parts.

An important advantage of the improved timepiece is that it can accurately indicate any time of the day with a small number of radiation sources. Moreover, the circuit which selectively activates or deactivates such radiation sources is relatively simple and compact so that it can be confined in a small housing, even if the housing is to further contain one or more batteries or analogous portable energy sources. The timepiece can constitute a watch or a clock.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An electrically operated timepiece comprising a housing; a dial provided on said housing and having at most seventeen radiation sources to indicate hours and minutes, said sources including twelve first radiation sources forming a substantially annular first symmetrical array, and a second symmetrical array of four second radiation sources within the confines of said first array, said radiation sources being arranged to emit radiation in response to connection with a source of electrical energy, said dial having a substantially square or rectangular outline and including four corner portions and said housing having means for maintaining said dial in such orientation that one of said corner portions is located at a level below all other corner portions when the maintaining means is placed onto a substantially horizontal surface; and means for selectively connecting said radiation source to an energy source.

2. The timepiece of claim 1, wherein the radiation sources of said first array form a square or a rectangle with a radiation source at each corner of the first array and with two radiation sources between each pair of neighboring corners.

3. The timepiece of claim 1, wherein said dial has four sides, said first radiation sources forming four rows of four radiation sources each and each such row being adjacent and parallel to one of said sides, each first radiation source at a corner of the first array being common to a pair of said rows.

4. The timepiece of claim 1, wherein the radiation sources of said second array include two pairs of radiation sources and such pairs are mirror symmetrical to each other with reference to a plane which is normal to said dial and is disposed between said pairs.

5. The timepiece of claim 1, wherein said first array has a center and further comprising an additional radiation source at the center of said first array.

6. The timepiece of claim 5, wherein said second array has a center substantially coinciding with the center of said first array.

7. The timepiece of claim 5, wherein at least one of said radiation sources includes means for emitting light of a first color or hue and at least one other radiation source includes means for emitting light of a different second color or hue.

8. The timepiece of claim 5, wherein at least one of said radiation sources has a first size and at least one other radiation source has a different second size.

9. The timepiece of claim 5, wherein at least one of said radiation sources has a first shape and at least one other radiation source has a different second shape.

10. The timepiece of claim 5, wherein at least of said radiation sources includes a light emitting diode which is arranged to emit light of different colors or hues.

11. The timepiece of claim 1, wherein said dial and said housing are parts of a clock.

12. The timepiece of claim 1, wherein the radiation sources of said first array occupy one to twelve o'clock positions.

13. The timepiece of claim 12, wherein the radiation sources of said second array are inwardly adjacent the radiation sources of said first array at the twelve, three, six and nine o'clock positions.

14. The timepiece of claim 1, wherein the radiation sources of at least one of said arrays are substantially equidistant from each other.

* * * * *